US008196506B2

(12) United States Patent
Sabha et al.

(10) Patent No.: US 8,196,506 B2
(45) Date of Patent: Jun. 12, 2012

(54) VARIABLE STROKE COMPRESSOR DESIGN

(75) Inventors: Nick G. Sabha, Lewiston, NY (US); Douglas E. Webster, Clarence, NY (US)

(73) Assignee: Delphi Technologies, Inc., Troy, MI (US)

( * ) Notice: Subject to any disclaimer, the term of this patent is extended or adjusted under 35 U.S.C. 154(b) by 417 days.

(21) Appl. No.: 12/542,126

(22) Filed: Aug. 17, 2009

(65) Prior Publication Data

US 2011/0038739 A1 Feb. 17, 2011

(51) Int. Cl.

| | |
|---|---|
| ***F01B 9/02*** | (2006.01) |
| ***F01B 31/14*** | (2006.01) |
| ***F15B 15/24*** | (2006.01) |
| ***F04B 1/26*** | (2006.01) |

(52) U.S. Cl. ..... 92/13; 417/222.1

(58) Field of Classification Search ..... 417/222.1, 417/269; 92/12.2, 13

See application file for complete search history.

(56) References Cited

U.S. PATENT DOCUMENTS

| | | | | |
|---|---|---|---|---|
| 2,711,135 | A * | 6/1955 | Dunlap | 417/222.1 |
| 3,153,899 | A * | 10/1964 | Budzich et al. | 60/629 |
| 3,188,971 | A * | 6/1965 | Puryear | 417/222.1 |
| 4,685,866 | A * | 8/1987 | Takenaka et al. | 417/222.2 |
| 5,129,752 | A * | 7/1992 | Ebbing et al. | 403/24 |
| 5,803,714 | A * | 9/1998 | Tominaga et al. | 417/269 |
| 6,146,110 | A * | 11/2000 | Higashihara et al. | 417/269 |
| 6,564,695 | B2 * | 5/2003 | Herder et al. | 92/12.2 |
| 6,578,465 | B2 * | 6/2003 | Tagami | 92/12.2 |
| 6,669,450 | B2 * | 12/2003 | Jeong | 417/269 |
| 6,766,726 | B1 * | 7/2004 | Schwarzkopf | 92/12.2 |
| 6,802,243 | B2 * | 10/2004 | Matsuda et al. | 92/12.2 |
| 7,972,118 | B2 * | 7/2011 | Hirabayashi et al. | 417/269 |
| 2004/0055456 | A1 * | 3/2004 | Kurita et al. | 92/12.2 |
| 2004/0062660 | A1 * | 4/2004 | Kazahaya et al. | 417/222.1 |
| 2007/0220859 | A1 * | 9/2007 | Kubo et al. | 60/226.3 |
| 2009/0064855 | A1 * | 3/2009 | Kayukawa | 92/12.2 |
| 2009/0145293 | A1 * | 6/2009 | Kawachi et al. | 91/505 |
| 2009/0148313 | A1 * | 6/2009 | Miyaji | 417/269 |
| 2009/0178552 | A1 * | 7/2009 | Kawamura et al. | 91/505 |
| 2009/0311109 | A1 * | 12/2009 | Bona et al. | 417/53 |

* cited by examiner

*Primary Examiner* — Devon C Kramer
*Assistant Examiner* — Christopher Maxey
(74) *Attorney, Agent, or Firm* — Thomas N. Twomey

(57) ABSTRACT

A pump includes a piston block defining piston bores, and pistons disposed in the piston bores. A swash device defines a swash bore about a swash central axis ($C_{SW}$) and a swash rotation axis ($C_R$). A pivotal connection pivotally connects each of the pistons to the swash device for rotation about a connection pivot point during relative movement between the swash device and the piston. The connection pivot points are aligned in a plane (P). A shaft supported by the housing passes through the swash bore and defines a shaft central axis ($C_{SH}$). A hinge assembly pivotally supports the swash device about a hinge axis ($C_{HI}$) disposed on the opposite side of the plane (P) from the piston block. The swash rotation axis ($C_R$) of the swash device is offset from the plane (P) away from the hinge axis ($C_{HI}$) and is radially offset from the swash center axis in a direction toward the hinge axis ($C_{HI}$).

20 Claims, 2 Drawing Sheets

VARIABLE STROKE COMPRESSOR DESIGN

BACKGROUND OF THE INVENTION

1. Field of the Invention

The subject invention relates to swash plate axial piston pumps including condition responsive control of pump displacement.

2. Description of the Prior Art

In such pumps, the relative locations of the swash rotation axis, swash central axis of the swash device, and the plane containing the connection pivot points between the pistons and the swash device affect the performance characteristics of the pump such as maintaining clearance between the pistons and the valve plate and bias of the swash device to rotate to a higher or lower angle position. To increase the displacement of such a pump, the prior art typically employed three strategies: adding more pistons, increasing the diameter of the pistons, or increasing the diameter of the swash device to increase the stroke length of each piston. Each of these strategies necessarily increases the size and/or complexity to the pump, and therefore added cost or weight.

An example of an swash plate axial piston pump including condition responsive control of pump displacement is disclosed in U.S. Pat. No. 5,644,968 to Kimura. The '968 patent discloses a housing that has a piston block disposed therein which defines a plurality of piston bores. A piston is disposed and translational in each of the piston bores. A swash device defines a swash bore about a swash central axis and defines a swash rotation axis for rotation thereabout. A pivotal connection pivotally connects each of the pistons to the swash device for rotation about a connection pivot point during relative movement between the swash device and piston. The connection pivot points are aligned in a plane. A shaft is supported by the housing and passes through the swash bore and defines a shaft central axis. A hinge assembly pivotally supports the swash device about a hinge axis disposed on the opposite side of the plane from the piston block and is movable radially relative to the shaft central axis during relative movement of the swash device along the shaft. The swash rotation axis is offset from the plane away from the hinge axis and radially offset from the swash center axis away from the hinge axis to limit the clearance between the pistons and a valve plate disposed on the opposite side of the pistons from the swash device.

U.S. Pat. No. 5,253,576 to Bethke discloses a pump having a plurality of pistons and a swash device defining a swash center axis and a swash rotation axis. A pivotal connection connects each of the pistons to the swash device for rotation about a connection pivot point during relative movement between the swash device and the piston. The connection pivot points are aligned on a plane. A hinge assembly pivotally supports the swash device and is disposed on the opposite side of the plane from the piston block. The swash rotation axis is offset from the plane toward the hinge assembly and radially offset from the swash center axis toward the hinge assembly to bias the swash device to a higher angle position.

SUMMARY OF THE INVENTION

Contrary to such prior art, the subject invention provides a new relationship wherein the swash rotation axis is offset from the plane away from the hinge axis and is radially offset from the swash center axis toward the hinge axis.

ADVANTAGES OF THE INVENTION

The present invention repositions the reaction forces that the swash device experiences from the relative pushing and pulling on the swash device by the pistons. Accordingly, the upstroking of the pistons is greatly improved, especially at low speeds when the inertia of the swash device is less significant. As a result, the pump has a higher effective output than a similar pump of the same number of pistons, same piston diameter, and same swash device diameter.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
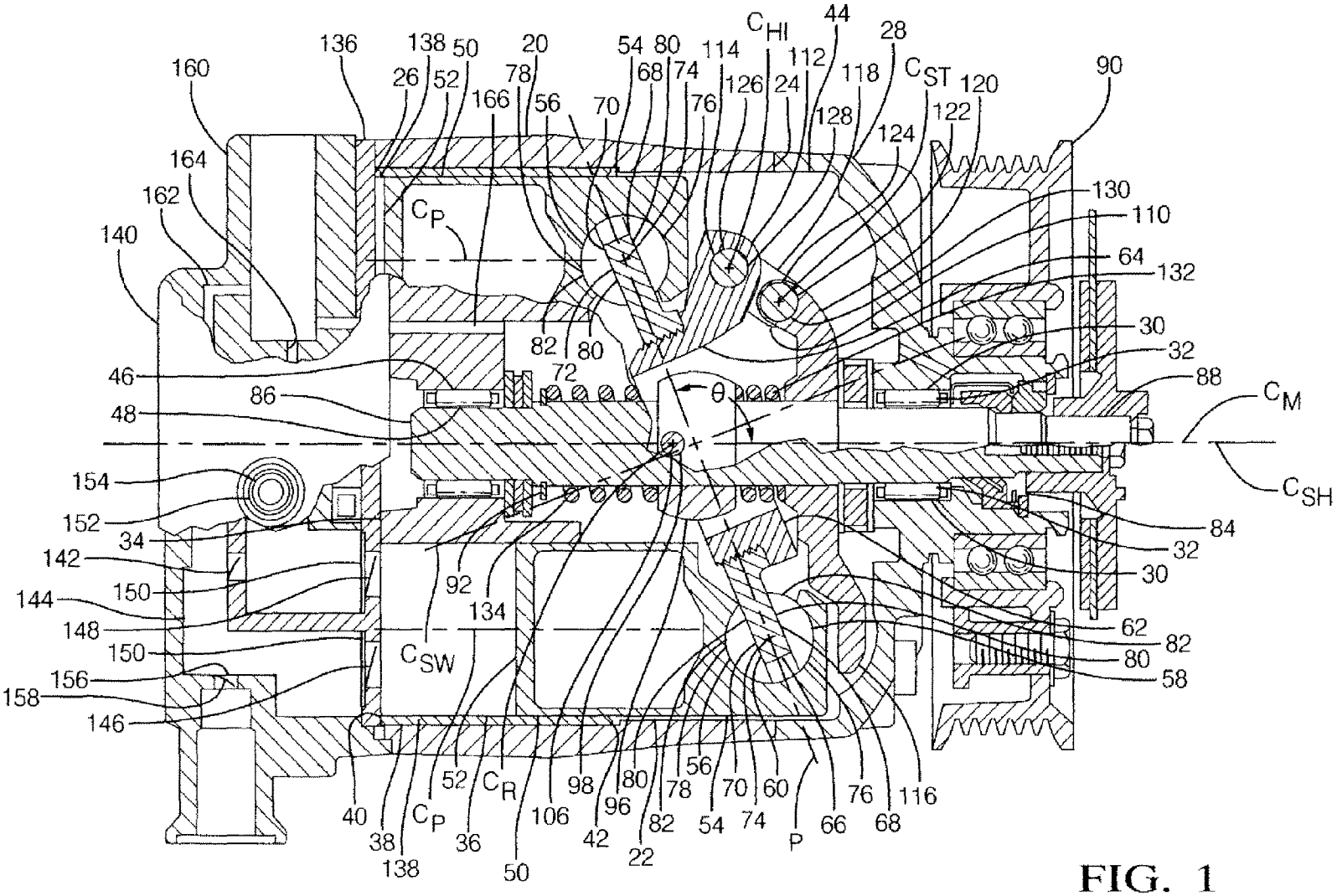
FIG. 1 is a side view of a sector of a pump in accordance with the subject invention.
Figure 2:
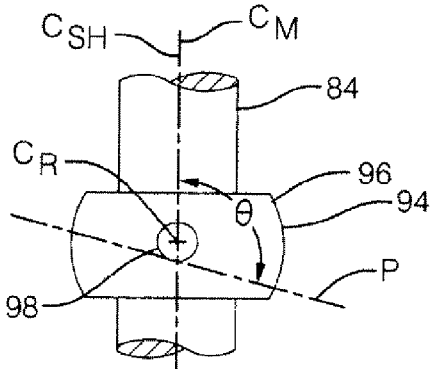
FIG. 2 is a side view of a sleeve on a shaft in accordance with the subject invention.
Figure 3:
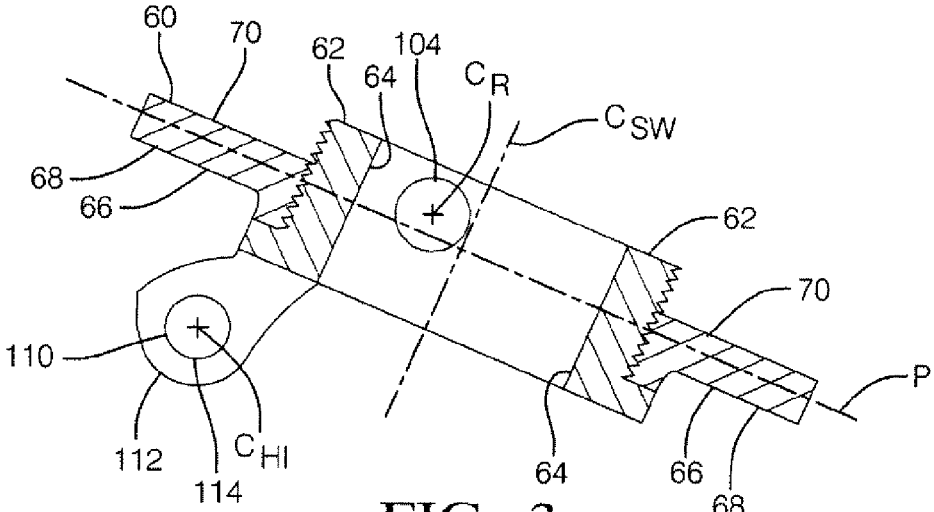
FIG. 3 is a side view of a sector of a swash device in accordance with the subject invention.
Figure 4:
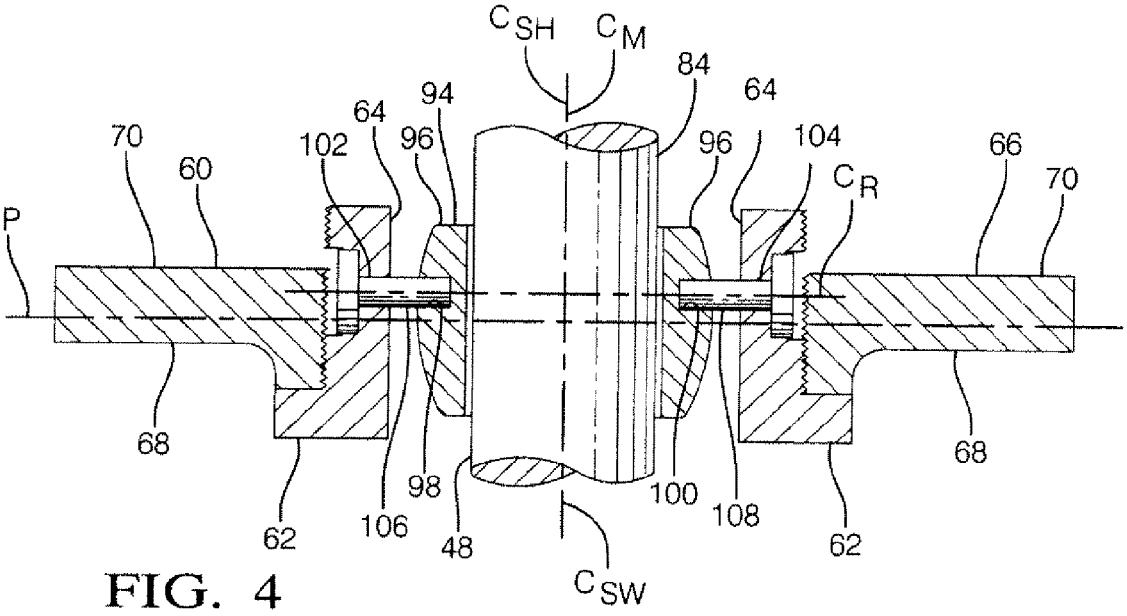
FIG. 4 is a front view of a sector of a swash device, a sleeve, and pivot pins on a shaft in accordance with the subject invention.

Referring to the Figures, wherein like numerals indicate corresponding parts throughout the several views, the invention comprises a pump or compressor, as shown generally at FIG. 1. A housing 20 defines a main central axis $C_M$, an inside diameter 22, a front opening 24, and a rear opening 26. The rear opening 26 is disposed opposite the front opening 24, and both are on the main central axis $C_M$. A crank cover or front housing cover 28 covers the front opening 24. The front housing cover 28 defines a shaft opening 30 coaxial with the main central axis $C_M$. A front bearing 32 or guide is disposed in the shaft opening 30.

A cylinder or piston block 34 coaxial with the housing 20 defines a plurality of cylinder or piston bores 36. Each of the piston bores 36 define a piston bore axis $C_P$ and each of the piston bore axes $C_P$ are parallel to each other. The piston block 34 is disposed within the housing 20 and has an outside diameter 38 engaging the inside diameter 22 of the housing 20. The piston block 34 has a rear surface 40 adjacent to and coplanar with the rear opening 26 and a front surface 42 that is opposite the rear surface 40. The front surface 42 of the piston block 34 and the front housing cover 28 define an internal crank chamber 44 therebetween. The piston block 34 defines a shaft bore 46 along the main central axis $C_M$. A rear bearing 48 or guide is disposed in the shaft bore 46.

A piston 50 is disposed and translational in each of the piston bores 36 along the piston bore axis $C_P$. Each of the pistons 50 has a bore end 52 disposed in the piston bore 36, and a crank end 54 opposite the bore end 52 and exposed to the crank chamber 44. Each of the crank ends 54 are C-shaped and define a rear socket 56 that is concave and faces away from the piston block 34 and a front socket 58 opposite the rear socket 56 that is concave and faces the piston block 34.

A swash device 60 is disposed in the crank chamber 44 and includes a journal 62 that defines a swash bore 64 about a swash central axis $C_{SW}$ and defines a swash rotation axis $C_R$ for rotation thereabout. The swash device 60 includes a swash plate 66 supported by the journal 62 and having a front face 68 facing away from the piston block 34 and a rear face 70 parallel and opposite the front face 68 and facing toward the piston block 34.

A pivotal connection 72 pivotally connects each of the pistons 50 to the swash device 60 for rotation about a connection pivot point 74 during relative movement between said swash device 60 and said piston 50. The connection pivot points 74 are aligned in a plane P. The plane P is parallel to the front and rear faces 68, 70 of the swash plate 66 and bisects the swash plate 66 midway between the front face 68 and the rear face 70 of the swash plate 66.

Each of the pivotal connections 72 include shoes 76, 78 being hemispherical in shape and having a flat surface 80 which is flat, and a convex surface 82 opposite the flat surface 80. The convex surfaces 82 are convex and shaped complementary to the sockets 56, 58. Each of the pivotal connections 72 has a front shoe 76 and the flat surface 80 of the front shoe 76 is disposed and slidable on the front face 68 of the swash plate 66. The convex surface 82 of the front shoe 76 is disposed on and slidable on the front socket 58 of the piston 50. Each of the pivotal connections 72 has a rear shoe 78 opposite the front shoe 76. The flat surface 80 of each of the rear shoes 78 is disposed and slidable on the rear face 70 of the swash plate 66 and the convex surface 82 is disposed and slidable on the rear socket 56 of the piston 50.

A bar or shaft 84 defines a shaft central axis $C_{SH}$ and is coaxial with the main central axis $C_M$. The shaft 84 has a rear end 86 which extends through the shaft opening 30 and the crank chamber 44. The rear bearing 48 rotatably supports the rear end 86 of the shaft 84. The shaft 84 has a front end 88 opposite the rear end 86. The front bearing 32 rotatably supports the shaft 84 between the front end 88 and the rear end 86. A pulley 90 is fixed to the front end 88 of the shaft 84 and is used to rotate the shaft 84. A ring 92 is fixed to and about the shaft 84 adjacent the front face 68 of the piston block 34.

A connector joint 94 is rotatably connected to the swash device 60 about the swash rotation axis $C_R$. The connector joint 94 includes a sleeve 96 or slide disposed within the swash bore 64 and about and translational along the shaft 84. The swash rotation axis $C_R$ extends through the sleeve 96 and travels with the sleeve 96 as it translates along the shaft 84. The sleeve 96 defines a first sleeve hole 98 and a second sleeve hole 100. The sleeve holes 98, 100 are coaxial to each other and extend transversely to the shaft 84. The journal 62 defines a first and second journal rotation hole 102, 104 and the journal rotation holes 102, 104 are coaxial to each other and to the sleeve holes 98, 100 and define the swash rotation axis $C_R$ of the swash device 60 about the sleeve 96.

The connector joint 94 includes a first journal rotation pin 106 which extends through the first sleeve hole 98 and the first journal rotation hole 102 and rotatably connects the journal 62 to the sleeve 96 about the swash rotation axis $C_R$. A second journal rotation pin 108 extends through the second sleeve hole 100 and the second journal rotation hole 104 and rotatably connects the journal 62 to the sleeve 96 about the swash rotation axis $C_R$.

A hinge assembly 110 pivotally supports the swash device 60 about a hinge axis $C_{HI}$ disposed on the opposite side of the plane P from the piston block 34. The hinge axis $C_{HI}$ is movable radially relative to the shaft central axis $C_{SH}$ during relative movement of the sleeve 96 along the shaft 84. The hinge assembly 110 includes the journal 62 defining a pair of parallel and offset journal ears 112. Each ear extends radially outward from the journal 62 and is circumferentially aligned with one of the sleeve holes 98, 100. Each of the journal ears 112 define a journal lever hole 114 extending transversely to the shaft 84 and parallel to the swash rotation axis $C_R$ and axially offset from the swash rotation axis $C_R$. Each journal lever hole 114 is coaxial to each other journal lever hole 114 and the journal lever holes 114 define the hinge axis $C_{HI}$.

The hinge assembly 110 includes a rotor 116 disposed in the crank chamber 44 and fixed to the shaft 84 adjacent the front bearing 32. The hinge assembly 110 includes a pair of hinge links 118 rotatably connected to the swash device 60 about the hinge axis $C_{HI}$ and rotatably connected to the rotor 116 about a static axis $C_{ST}$ which is fixed relative to the shaft 84. The rotor 116 defines a pair of parallel and offset rotor ears 120 extending radially outward from the rotor 116 toward the journal ears 112. Each rotor ear 120 is circumferentially aligned with one journal ear 112. Each of the rotor ears 120 defines a rotor hole 122 extending parallel to the swash rotation axis $C_R$ and axially offset from the sleeve holes 98, 100. Each rotor hole 122 is coaxial to each other rotor hole 122 and define the static axis $C_{ST}$.

The hinge links 118 are disposed in the crank chamber 44 and each define an front hinge hole 124 and a rear hinge hole 126. A rear hinge pin 128 is disposed through the rear hinge holes 126 and the journal lever holes 114 thereby rotatably connecting the hinge links 118 and the journal 62 about the hinge axis $C_{HI}$. A front hinge pin 130 is disposed through the front hinge holes 124 and the rotor holes 122 thereby rotatably connecting the hinge links 118 and the rotor 116 about the static axis $C_{ST}$.

A front bias spring 132 is disposed about the shaft 84 and extends between the rotor 116 and the sleeve 96. A rear bias spring 134 is disposed about the shaft 84 and extends between the sleeve 96 and the piston block 34.

A disc-like valve plate 136 having a diameter as least as great as the outside diameter 38 of the piston block 34 is fixed to the rear surface 40 of the piston block 34. Each piston 50 and the valve plate 136 define a piston chamber 138 therebetween. A head cover or rear housing cover 140 is disposed over the valve plate 136. The rear housing cover 140 and the valve plate 136 define a discharge chamber 142 and a suction chamber 144 therebetween. The valve plate 136 defines a plurality of suction orifices 146 and discharge orifices 148. One suction orifice 146 is disposed between the suction chamber 144 and each piston chamber 138. One discharge orifice 148 is disposed between the discharge chamber 142 and each piston chamber 138. A flow control valve 150 is disposed in each of the orifices 146, 148.

The rear housing cover 140 defines an outlet valve opening 152 adjacent the discharge chamber 142, and an outlet valve 154 is disposed in the outlet valve opening 152. The rear housing cover 140 defines an inlet valve opening 156 adjacent the suction chamber 144, and an inlet valve 158 is disposed in the inlet valve opening 156. A crank pressure control valve 160 is disposed in the rear housing cover 140 adjacent to both the suction chamber 144 and the discharge chamber 142. The rear housing cover 140 defines a suction control channel 162 between the suction chamber 144 and the crank pressure control valve 160. The rear housing cover 140 defines a discharge control channel 164 between the discharge chamber 142 and the crank pressure control valve 160. The piston block 34, the valve plate 136, and the rear housing cover 140 define a pressure control channel 166 between the crank chamber 44 and the crank pressure control valve 160.

Each of the pistons 50 is in a top dead center position as the piston 50 alternates from approaching the valve plate 136 to retreating from said valve plate 136 and in a bottom dead center position as the piston 50 alternates from retreating from the valve plate 136 to approaching the valve plate 136. Each of the pistons 50 has a variable stroke length being the distance between the top dead center position and the top dead center position. The plane P and the shaft central axis $C_{SH}$ define a plane tilt angle θ. The angle θ decreases as the plane P approaches perpendicular with the shaft central axis $C_{SH}$ and the plane tilt angle θ increases in the opposite direction.

The swash rotation axis $C_R$ of the swash device 60 is offset from the plane P away from the hinge axis $C_{HI}$ and is radially offset from the swash center axis $C_{SW}$ in a direction toward the hinge axis $C_{HI}$.

Accordingly, the pulley 90, shaft 84, rotor 116, sleeve 96, journal 62, and swash plate 66 rotate together about the main central axis $C_M$ as the shoes 76, 78 slide across the faces 68, 70 of the swash plate 66 and the pistons 50 reciprocate between top dead center position and bottom dead center. A working fluid disposed in the crank chamber 44 exerts crank pressure on each piston 50 and a working fluid disposed in each piston chamber 138 exerts piston pressure on each piston 50.

In response to the average of piston chamber 138 pressures increasing in relation to crank pressure the pistons 50 collectively push the swash plate 66 and the sleeve 96 along the shaft 84 toward the front housing cover 28 and thereby increasing the tilt angle θ of the plane P which increases the stroke length of the pistons 50. In response to the average of the piston chamber 138 pressures decreasing in comparison to the crank chamber 44 pressure the pistons 50 collectively pull the swash plate 66 and the sleeve 96 along the shaft 84 toward the piston block 34 and thereby decreasing the plane tilt angle θ and decreasing the stroke length of the pistons 50.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An swash plate axial piston pump having condition responsive control of pump displacement, said pump comprising:

a housing having a piston block disposed therein, said piston block defining a plurality of piston bores, a piston disposed and translational in each of said piston bores, a swash device defining a swash bore about a swash central axis and defining a swash rotation axis for rotation thereabout, a pivotal connection pivotally connecting each of said pistons to said swash device for rotation about a connection pivot point during relative movement between said swash device and said piston, said connection pivot points being aligned in a plane, a shaft supported by said housing and passing through said swash bore and defining a shaft central axis, a hinge assembly pivotally supporting said swash device about a hinge axis disposed on the opposite side of said plane from said piston block and movable radially relative to said shaft central axis during relative movement of said swash device along said shaft, and said swash rotation axis being offset from said plane away from said hinge axis and radially offset from said swash central axis toward said hinge axis.

2. A pump as set forth in claim 1 wherein said hinge assembly includes a rotor fixed to and rotatable with said shaft.

3. A pump as set forth in claim 2 wherein said hinge assembly includes at least one hinge link rotatably connected to said swash device about said hinge axis and rotatably connected to said rotor about a static axis fixed relative to said shaft.

4. A pump as set forth in claim 3 including a connector joint rotatably connected to said swash device about said swash rotation axis and having a sleeve disposed within said swash bore and translational along said shaft and defining a first sleeve hole and a second sleeve hole coaxial with each other and extending transversely to said shaft and said swash device defining a first journal rotation hole and a second journal rotation hole coaxial with each other and said first and second sleeve holes to define said swash rotation axis.

5. A pump as set forth in claim 4 wherein said swash device includes a journal defining said swash bore and a pair of parallel and offset journal ears extending radially outward from said journal and each said journal ear circumferentially aligned with one said sleeve hole and defining a journal lever hole extending transversely to said shaft and parallel to said swash rotation axis and axially offset from said swash rotation axis and each said journal lever hole being coaxial to each other said journal lever hole and defining said hinge axis.

6. A pump as set forth in claim 5 wherein said swash device includes a swash plate supported by said journal and having a front face facing away from said piston block and a rear face parallel and opposite said front face and facing toward said piston block.

7. A pump as set forth in claim 6 including said plane being parallel to said front and rear faces of said swash plate and bisecting said swash plate and midway between said front face and said rear face of said swash plate.

8. A pump as set forth in claim 7 wherein each of said pistons bores define a piston bore axis and said piston bore axes being parallel to each other and said pistons translational along said piston bore axes and having a bore end disposed in said piston bore and a crank end opposite said bore end and said crank end being C-shaped and defining a rear socket being concave and facing away from said piston block and a front socket being concave and opposite said rear socket and facing said piston block.

9. A pump as set forth in claim 8 wherein said pivotal connections include shoes being hemispherical in shape and having a flat surface being flat and a convex surface opposite said flat surface and being convex and shaped complementary to said sockets and said shoes including a front shoe having said flat surface disposed and slidable on said front face of said swash plate and said convex surface disposed and slidable on said front socket of said piston and a rear shoe having said flat surface of said rear shoe opposite and facing said flat surface of said front shoe and disposed and slidable on said rear face of said swash plate and said convex surface of said rear shoe facing away from said front shoe and disposed and slidable on said rear socket of said piston.

10. A pump as set forth in claim 5 wherein said rotor of said hinge assembly defines a pair of parallel and offset rotor ears extending radially outward from said rotor toward and circumferentially aligned with said journal ears and each of said rotor ears defining a rotor hole extending parallel to said swash rotation axis and axially offset from said sleeve holes and said rotor holes being coaxial to each other and defining said static axis.

11. A pump as set forth in claim 10 including said hinge assembly having a pair of said hinge links each defining a front hinge hole rotatably connected to said rotor ears about said static axis and a rear hinge hole rotatably connected to said swash device about said hinge axis and a rear hinge pin disposed through said rear hinge holes and said journal lever holes and rotatably connecting said hinge links and said journal about said hinge axis and a front hinge pin disposed through said rotor hinge holes and said front hinge holes rotatably connecting said hinge links and said rotor.

12. A pump as set forth in claim 5 wherein said connector joint includes a first journal rotation pin extending through said first sleeve hole and said first journal rotation hole and rotatably connecting said journal to said sleeve about said swash rotation axis and a second journal rotation pin coaxial with said first journal rotation pin and extending through said second sleeve hole and said second journal rotation hole and rotatably connecting said journal to said sleeve about said swash rotation axis and said journal rotatable about said swash rotation axis.

13. A pump as set forth in claim 1 including said housing having a cylindrical shape defining a main central axis and an inside diameter and a front opening and a rear opening and said rear opening being disposed opposite said front opening and both openings being on said main central axis and said piston block being coaxial with said housing and having an outside diameter engaging said inside diameter of said housing and a rear surface adjacent to and coplanar with said rear opening and a front surface opposite said rear surface and defining a shaft bore along said main central axis and a rear bearing disposed in said shaft bore.

14. A pump as set forth in claim 13 including a front housing cover covering said front opening and defining a shaft opening coaxial with said main central axis and a front bearing disposed in said shaft opening and said front surface of said piston block and said front housing cover defining an internal crank chamber therebetween.

15. A pump as set forth in claim 13 including said shaft being coaxial with said main central axis and having a rear end extending through said shaft opening and said crank chamber and rotatably supported by said rear bearing and a front end opposite said rear end and having a pulley fixed to said front end of said shaft for rotating said shaft and said front bearing rotatably supporting said shaft between said front end and said rear end.

16. A pump as set forth in claim 4 including a ring being fixed to and about said shaft adjacent said piston block and a front bias spring disposed about said shaft and extending between said rotor and said sleeve and a rear bias spring disposed about said shaft and extending between said sleeve and said ring.

17. A pump as set forth in claim 8 including said housing having a cylindrical shape defining a main central axis and an inside diameter and a front opening and a rear opening and said piston block being coaxial with said housing and having an outside diameter engaging said inside diameter of said housing and a rear surface adjacent to and coplanar with said rear opening and a disc-like valve plate having a diameter at least as great as said outside diameter of said piston block fixed to said rear surface of said piston block and each of said bore ends and said valve plate defining a piston chamber therebetween and a rear housing cover disposed over said valve plate and said rear housing cover and said valve plate defining a discharge chamber and a suction chamber and said valve plate defining a plurality of suction orifices and one of said suction orifices disposed between said suction chamber and each said piston chamber and discharge orifices and one of said discharge orifices disposed between said discharge chamber and each said piston chamber and a flow control valve disposed in each said orifice.

18. A pump as set forth in claim 17 wherein said rear housing cover defines an outlet valve opening adjacent said discharge chamber and an outlet valve disposed in said outlet valve opening and said rear housing cover defining an inlet valve opening adjacent said suction chamber and an inlet valve disposed in said inlet valve opening.

19. A pump as set forth in claim 17 including a front housing cover covering said front opening and said piston block having a front surface disposed opposite said rear surface and said front surface of said piston block and said front housing cover defining an internal crank chamber therebetween and wherein a crank pressure control valve is disposed between said rear housing cover and said valve plate and adjacent to both said suction chamber and said discharge chamber and said rear housing cover defines a suction control channel between said suction chamber and said crank pressure control valve and a discharge control channel between said discharge chamber and said crank pressure control valve and said piston block and said valve plate defining a pressure control channel between said crank chamber and said crank pressure control valve.

20. A pump as set forth in claim 19 wherein said pivotal connections include shoes being hemispherical in shape and having a flat surface being fiat and a convex surface opposite said flat surface and being convex and shaped complementary to said sockets and said shoes including said front shoe having said flat surface disposed and slidable on said front face of said swash plate and said convex surface disposed and slidable on said front socket of said piston and a rear shoe having said flat surface of said rear shoe opposite and facing said flat surface of said front shoe and disposed and slidable on said rear face of said swash plate and said convex surface of said rear shoe facing away from said front shoe and disposed and slidable on said rear socket of said piston, said rotor of said hinge assembly defines a pair of parallel and offset rotor ears extending radially outward from said rotor toward and circumferentially aligned with said journal ears and each of said rotor ears defining a rotor hole extending parallel to said swash rotation axis and axially offset from said sleeve holes and said rotor holes being coaxial to each other and defining said static axis, said connector joint includes a first journal rotation pin extending through said first sleeve hole and said first journal rotation hole and rotatably connecting said journal to said sleeve about said swash rotation axis and a second journal rotation pin coaxial with said first journal rotation pin and extending through said second sleeve hole and said second journal rotation hole and rotatably connecting said journal to said sleeve about said swash rotation axis and said journal rotatable about said swash rotation axis, said housing having a cylindrical shape defines a main central axis and an inside diameter and a front opening and a rear opening and said rear opening being disposed opposite said front opening and both openings being on said main central axis and said piston block being coaxial with said housing and having an outside diameter engaging said inside diameter of said housing and a rear surface adjacent to and coplanar with said rear opening and a front surface opposite said rear surface and defining a shaft bore along said main central axis and a rear bearing disposed in said shaft bore, a front housing cover covering said front opening defines an internal crank chamber between said front housing cover and said front surface of said piston block and defining a shaft opening coaxial with said main central axis, and a front bearing disposed in said shaft opening, said shaft being coaxial with said main central axis and has a rear end extending through said shaft opening and said crank chamber and rotatably supported by said rear bearing and a front end opposite said rear end and having a pulley fixed to said front end of said shaft for rotating said shaft and said front bearing rotatably supporting said shaft between said front end and said rear end, a ring being fixed to and about said shaft adjacent said piston block and a front bias spring is disposed about said shaft and extending between said rotor and said sleeve and a rear bias spring disposed about said shaft and extending between said sleeve and said ring, said rear housing cover defines an outlet valve opening adjacent said discharge chamber and an outlet valve disposed in said outlet valve opening and rear housing cover defining an inlet valve opening adjacent said suction chamber and an inlet valve disposed in said inlet valve opening, each said piston being in a top dead center position as said piston alternates from approaching said valve plate to retreating from said valve plate and being in a bottom dead center position as said piston alternates from retreating from said valve plate to approaching said valve plate, and each of said pistons having a variable stroke length being the distance between said top dead center position and said bottom dead center position and said plane and said shaft central axis defining a plane tilt angle with said angle decreasing as said plane tilt angle approaches perpendicular with said shaft central axis and said plane tilt angle increasing in the opposite direction, and whereby said pulley and said shaft and said rotor and said sleeve and said journal and said swash plate rotate together about said main central axis as said shoes slide across said faces of said swash plate and said pistons reciprocate between said top dead center position and said bottom dead center position as a working fluid disposed in said crank chamber exerts crank pressure on each said piston and said working fluid disposed in each said piston chamber exerts piston pressure on each said piston and in response to an increase in the average of piston chamber pressures in relation to crank pressure said pistons collectively push said swash plate and said sleeve along said shaft toward said front housing cover to thereby increase said plane tilt angle which increases said stroke length of said pistons and in response to a decrease in the average of piston chamber pressures in relation to crank pressure said pistons collectively pull said swash plate and said sleeve along said shaft toward said piston block to thereby decrease said plane tilt angle to decrease said stroke length of said pistons.

* * * * *